US007201594B2

(12) United States Patent
van der Mee et al.

(10) Patent No.: US 7,201,594 B2
(45) Date of Patent: Apr. 10, 2007

(54) CONNECTION ASSEMBLY COMPRISING A SUPPORT PROVIDED WITH AN OPENING AND A CONNECTOR HOUSING MOUNTED ON THE SUPPORT

(75) Inventors: Marnix van der Mee, Montlouis sur Loire (FR); Henri Perrin, Chateau-Renault (FR)

(73) Assignee: Radiall, Rosny-Sous-Bois (FR)

( * ) Notice: Subject to any disclaimer, the term of this patent is extended or adjusted under 35 U.S.C. 154(b) by 0 days.

(21) Appl. No.: 11/297,460

(22) Filed: Dec. 9, 2005

(65) Prior Publication Data

US 2006/0141836 A1 Jun. 29, 2006

Related U.S. Application Data

(60) Provisional application No. 60/635,781, filed on Dec. 15, 2004.

(30) Foreign Application Priority Data

Dec. 10, 2004 (FR) ..... 04 52924

(51) Int. Cl.
*H01R 13/64* (2006.01)

(52) U.S. Cl. ..... 439/247

(58) Field of Classification Search ..... 439/247, 439/248, 378

See application file for complete search history.

(56) References Cited

U.S. PATENT DOCUMENTS 2,289,514 A 7/1942 Mastney et al.
2,871,457 A 1/1959 Jencks et al.
3,951,500 A 4/1976 Anderson
4,522,378 A * 6/1985 Nelson ..... 267/141.4
4,895,425 A * 1/1990 Iwano et al. ..... 385/60
5,211,577 A * 5/1993 Daugherty ..... 439/493
5,397,244 A * 3/1995 Generoli et al. ..... 439/248
6,715,931 B1 4/2004 Chen et al.
7,090,521 B2 * 8/2006 Nishio et al. ..... 439/248

FOREIGN PATENT DOCUMENTS

EP 1 139 505 A2 10/2001

* cited by examiner

*Primary Examiner*—Neil Abrams
*Assistant Examiner*—PhuongChi Nguyen
(74) *Attorney, Agent, or Firm*—Oliff & Berridge, PLC.

(57) ABSTRACT

A connection assembly may include:

a support including an opening, in particular a panel element including an opening, the opening extending substantially in a plane;

an electrical connector housing; and an assembly for assembling the connector housing to the support, the assembly being arranged firstly to enable the housing to be held relative to the support in a rest position in which the housing extends at least in part through the opening in the support, and secondly to enable the connector housing to move relative to the rest position, at least in a direction parallel to the plane of the opening, the assembly including at least one resilient return member arranged to be capable of deforming elastically to accompany movement of the connector housing in a direction parallel to the plane of the opening and to return the connector housing to the rest position.

27 Claims, 2 Drawing Sheets

CONNECTION ASSEMBLY COMPRISING A SUPPORT PROVIDED WITH AN OPENING AND A CONNECTOR HOUSING MOUNTED ON THE SUPPORT

This non provisional application claims the benefit of French Application No. 04 52924 filed on Dec. 10, 2004 and U.S. Provisional Application No. 60/635,781 filed on Dec. 15, 2004.

The present invention relates to a connection assembly comprising a support including an opening, in particular a panel element including an opening, and to a connector mounted on the support, and the invention also relates to such a connector housing and to equipment including the above-mentioned assembly.

BACKGROUND

In the field of aviation, certain pieces of on-board equipment need to be connected to an electrical power supply, and for this purpose they are provided with respective electrical connectors that can be male or female and that are designed to be coupled to complementary electrical connectors on installation.

By way of example, such a piece of equipment could comprise a kitchen element such as an oven, a hot plate, or a refrigerator.

SUMMARY

The invention seeks in particular to provide a connection assembly enabling the mechanical characteristics of the coupling between a connector and a complementary connector to be improved, in particular in the field of on-board equipment, and specifically equipment that is mounted on board an aircraft.

Thus, the invention provides a connection assembly comprising:

- a support including an opening, in particular a panel element including an opening, the opening extending substantially in a plane;
- an electrical connector housing; and
- assembly means for assembling the connector housing to the support, the assembly means being arranged firstly to enable the housing to be held relative to the support in a rest position in which the housing extends at least in part through the opening in the support, and secondly to enable the connector housing to move relative to its rest position, at least in a direction parallel to the plane of the opening, said assembly means including at least one resilient return member arranged to be capable of deforming elastically in order to accompany movement of the connector housing in a direction parallel to the plane of the opening and return the connector housing to its rest position.

By means of the invention, the connector housing is held on the support in a floating manner, enabling the connector secured to the support to be coupled correctly with a complementary connector, even in the event of the above-mentioned assembly being misaligned relative to the complementary connector.

In addition, said at least one resilient return member serves to return the connector housing towards its rest position after the connectors have been uncoupled.

Advantageously, the resilient return member is arranged to be capable of deforming elastically to accompany movement of the connector housing in a direction that is not parallel to the plane of the opening, in particular in a direction that is perpendicular to the plane of the opening.

In an embodiment of the invention, when in the rest position, the connector housing presents no contact with an edge of the opening, being in particular centered relative thereto.

While connectors are being uncoupled, the invention enables the connector to be recentered spontaneously relative to the opening in the support.

In an embodiment of the invention, when in the rest position, the connector housing does not present any contact with the support.

Preferably, while coupling, the connector housing of the invention is moved away from the support.

The resilient return member can serve to limit the amplitude of floating movement of the connector housing relative to the support, in particular in the plane of the opening.

In an embodiment of the invention, the resilient return member is arranged to work in compression. In a variant, the resilient return member can be arranged to work in traction.

The resilient return member is arranged in particular to exert a force on the connector tending to return it towards the support.

The resilient return member may comprise a coil spring, in particular a cylindrical or conical spring. In a variant, the resilient return member may comprise, for example, a block of compressible material, for example a block of elastomer material.

The resilient return member can serve to exert a force on the connector housing tending to press it against a complementary connector with which the connector housing is coupled.

Preferably, the resilient return member, and in particular a coil spring, presses against a portion of the housing, without surrounding the housing.

In an embodiment of the invention, the assembly means comprise at least one retaining member for retaining the resilient return member, the retaining member being secured to the support, preferably in rigid manner.

Advantageously, the resilient return member is secured over a fraction of its height to the retaining member in such a manner that over said fraction of its height there is substantially no radial clearance between the resilient return member and the retaining member.

When the resilient return member is a coil spring, the retaining member may include a shank extending between the turns of the spring, the shank preferably being connected to a head secured to one end of the spring. The shank and the head are preferably made as a single piece.

In an embodiment of the invention, one or more turns of the spring or a portion only of one turn, are engaged after a small amount of radial deformation around the above-mentioned head.

Thus, the spring can firstly be compressed in the axial direction of the shank, and secondly can exert a radial force, i.e. a force in a direction extending transversely to the shank, contributing to return the connector housing towards its rest position, when the housing is uncoupled.

Where appropriate, the resilient return member does not bear directly against the support.

Advantageously, the connector housing remains permanently engaged at least in part in the opening in the support, including when the housing is pushed fully away from the support.

Preferably, the assembly means comprise at least a first guide surface that is preferably annular, in particular substantially frustoconical, the connector housing includes at least a second guide surface that is preferably annular, in particular substantially frustoconical, and the first and second guide surfaces are arranged to bear one against the other when the connector housing is in its rest position.

These guide surfaces enable the connector housing to be positioned accurately relative to the support when the housing returns to its rest position.

In an embodiment of the invention, the first guide surface is made on the above-mentioned retaining member.

When the retaining member includes a base secured to the support, the first guide surface is advantageously made on the base. The shank, the head, and the base of the retaining member can be made as a single piece. In a variant, these various elements can be made separately and then assembled together.

In an embodiment of the invention, the connector housing includes an orifice through which said retaining member extends at least in part, the above-mentioned second guide surface possibly being adjacent to said orifice, in particular.

Preferably, the connector housing includes a shoulder, in particular an annular shoulder, against which the resilient return member comes to bear, said shoulder possibly being adjacent to the above-mentioned orifice. Also preferably, the resilient return member does not extend through said orifice.

In an embodiment of the invention, the connector housing includes a setback in which the resilient return member extends at least in part over a fraction of its height, preferably without leaving any radial clearance.

In particular, the resilient return member can be engaged in the setback after being subjected to a small amount of radial deformation.

Advantageously, the connector housing includes at least one lateral slot opening out into the said orifice arranged to enable the retaining member to be inserted into the orifice.

In an embodiment of the invention, the assembly means comprise at least two resilient return members and at least two retaining members, each associated with a respective resilient return member, enabling the connector housing to be held in at least two locations of the support, for example at three or four locations.

The connector housing may include at least one guide stud projecting from a face of the housing and arranged to co-operate with a complementary connector.

The connector housing may include at least one cavity, in particular at least two cavities, each arranged to receive an insulating block for holding electrical contacts.

The invention also provides a connector housing for forming an assembly as specified above, and also a retaining member for the assembly.

The invention also provides an electrical connector housing including an orifice and a substantially frustoconical guide surface adjacent to the orifice.

Advantageously, the housing includes a lateral slot opening out into the orifice.

The connector may be of the rectangular type or of the circular type.

The invention also provides on-board equipment, in particular equipment for mounting on board an aircraft, the equipment including a connection assembly as defined above.

BRIEF DESCRIPTION OF THE DRAWINGS

The invention can be better understood on reading the following detailed description of a non-limiting embodiment, and on examining the accompanying drawings, in which.

MORE DETAILED DESCRIPTION

Figure 1:
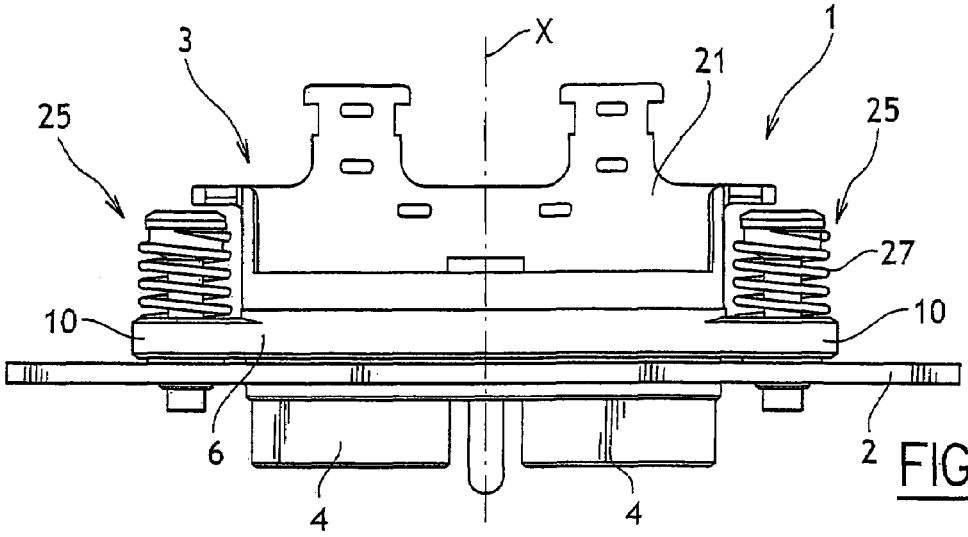
FIG. 1 is a diagrammatic and fragmentary side view of a connection assembly in accordance with the invention.

FIG. 1 shows a connection assembly in accordance with the invention and given overall reference 1, comprising a support 2 constituted by a panel element and a rectangular electrical connector housing 3 (not shown in full).

The plane of the panel element 2 extends perpendicularly to an axis X.

The panel element 2 is made of metal, in particular aluminum, for example.

The panel element 2 includes a rectangular opening 7, e.g. made in the center of the panel element 2.

Figure 3:
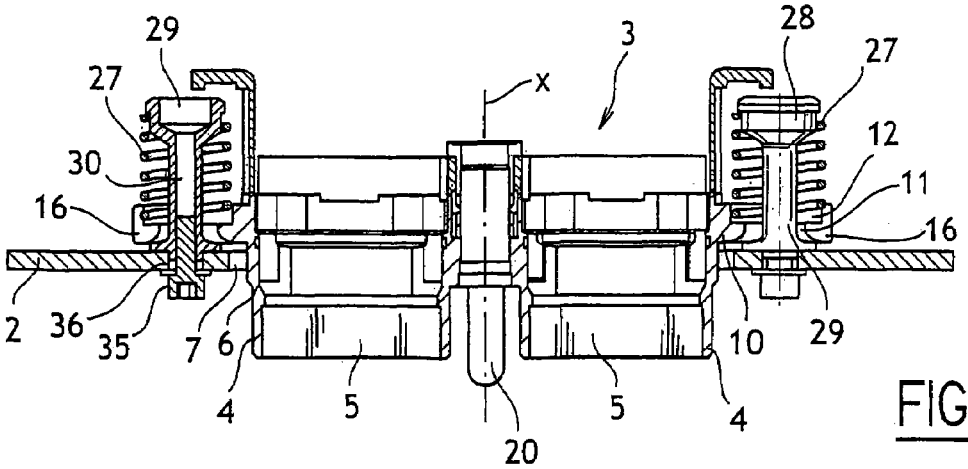
FIG. 3 is a diagrammatic and fragmentary section view on III—III of the FIG. 2 assembly.

The housing 3 is of the male type and comprises a housing body 6 defining two cavities 5, as can be seen in FIG. 3 in particular.

In a variant, the housing 3 could be of the female type.

The housing body 6, which is metal in the example described, has two tubular walls 4 of axis X that are substantially rectangular in section, each surrounding a cavity 5. In a variant, the housing body 6 may be made of plastics material or of composite material.

Each cavity 5 is arranged to receive an insulating block (not shown) provided with passages enabling electrical contacts (not shown) to be inserted therein.

Each electrical contact may be connected to an electric wire, for example.

In a variant not shown, the connector housing 3 could have a single cavity 5.

The housing 3 can receive retaining elements 18 arranged to co-operate with an insulating block (not shown) inserted in a cavity 5.

The retaining element 18 may comprise elastically-deformable tabs 19, for example.

The connector formed by the housing 3 is deigned for coupling to a complementary connector of female type (not shown).

Figure 2:
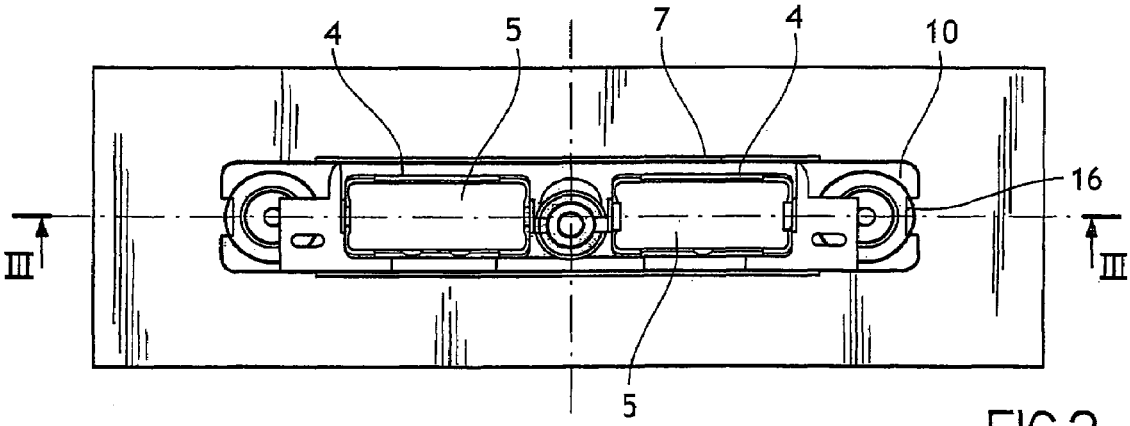
FIG. 2 is a diagrammatic and fragmentary plan view of the FIG. 1 assembly.

In plan view, as shown in FIG. 2, the housing 3 is generally rectangular in shape and has a projecting portion 10 at each longitudinal end.

Figure 4:
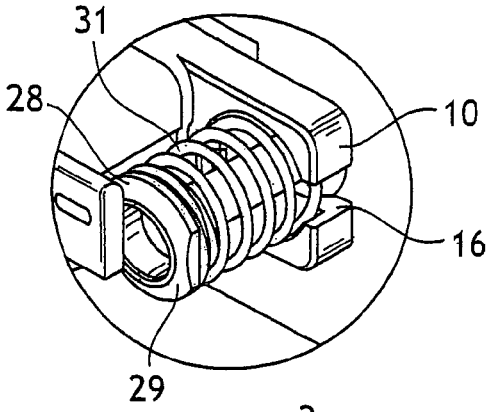
FIG. 4 is a diagrammatic and fragmentary perspective view of a detail of the FIG. 1 assembly.

Each portion 10 has an orifice 11 passing therethrough, extending substantially along the axis X, and including a lateral slot 16 opening out into the orifice 11, as can be seen in FIG. 4, in particular.

Figure 5:
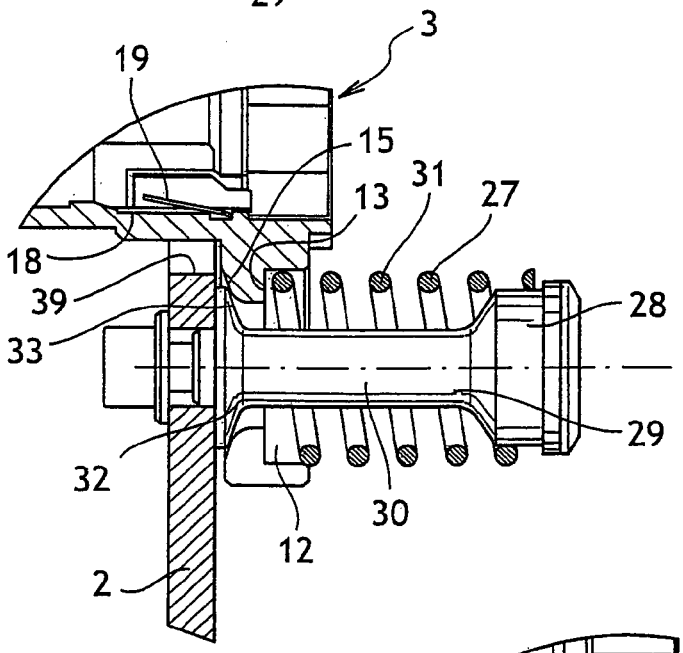
FIGS. 5 and 6 are diagrammatic and fragmentary section views on III—III showing a detail of the FIG. 3 assembly in two different positions.
Figure 6:
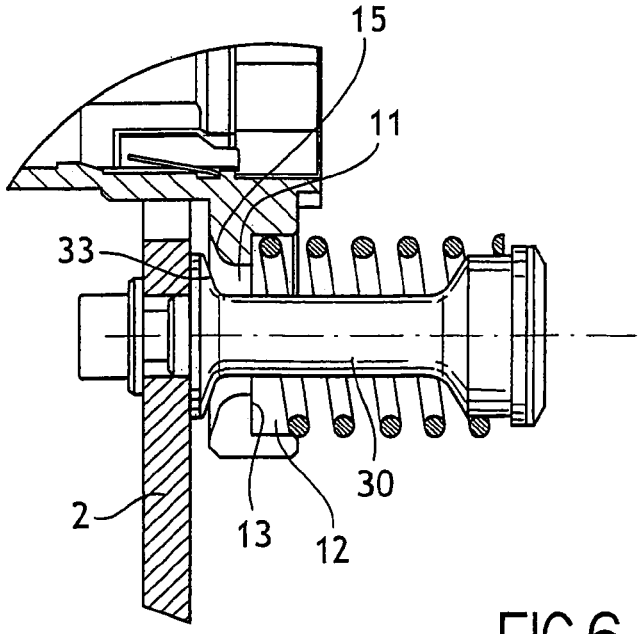

Each portion 10 includes a setback 12 into which the orifice 11 opens out, the setback 12 defining an annular shoulder 13 that is substantially perpendicular to the axis X, as shown in FIGS. 5 and 6 in particular.

Each portion 10 also presents a frustoconical guide surface 15 adjacent to the orifice 11 and on a face that faces the support 2.

The housing 3 has a guide stud 20 extending in front of the housing 3 and arranged to co-operate with a complementary connector during coupling.

The guide study 20 is disposed between the two tubular walls 4 and it presents a height that is greater than the height of the walls 4.

The housing 3 may include an element 21 for attaching to cables that are secured to the connector.

The housing 3 is mounted on the support 2 via assembly means 25 in such a manner that the tubular walls 4 extend through the opening 7 in the support 2.

The dimensions of the opening 7 are selected in such a manner that the housing 3, when partially engaged in the opening 7, can be moved in the plane of the support 2.

For each projecting portion 10 of the housing 3, the assembly means 25 include a resilient return member 27 constituted in the example described by a cylindrical coil spring working in compression.

Each spring 27 has one end engaged in a respective one of the setbacks 12 against the shoulder 13 of the housing 3, and has an opposite end secured to a head 28 of a retaining member 29.

The dimensions of the setback 12 are selected in such a manner that the spring 27 engages therein while deforming a little in the radial direction over a certain height and is held tightly therein without any radial clearance.

The spring 27 is also held tightly over a certain height around the head 28 without any radial clearance.

This method of securing the spring 27 at both ends enables it to exert a return force in a radial direction.

The head 28 is connected to a shank 30 extending parallel to the axis X and engaged between the turns 31 of the spring 27.

At its end opposite from the head 28, the shank 29 is connected to a base 32 secured to the support 2.

Each base 32 presents a frustoconical guide surface 33 against which the guide surface 15 of the housing 3 comes to bear when the housing is in a rest position, as shown in FIG. 5.

The shank 30 is engaged in the orifice 11 by being inserted via the lateral slot 16.

In the example described, the head 28, the shank 30, and the base 32 are made as a single piece.

As shown in FIG. 3, the shank 30 is hollow and presents an inside thread suitable for securing the retaining member 29 to the support 2 by means of a screw 35 extending through an orifice 36 in the support 2.

The retaining member 29 may be secured by any other equivalent means to the support 2, e.g. by crimping.

In the rest position, the housing 3 does not present any contact with the annular edge 39 of the opening 7, being substantially centered relative thereto.

When the housing 3 is coupled to a complementary connector, the housing 3 can be moved relative to the support 2, and in particular in the plane thereof, in order to compensate for any misalignment.

In the coupled position, and where appropriate, the housing 3 can be moved along the axis X so as to compress the springs 27.

While the connector housing 3 is being uncoupled, the springs 27 can exert a radial return force because each of them is secured to a head 28 of a shank 30 passing through the corresponding spring 27, with the return force serving to center the connector housing 3 relative to the opening 7 in the support 2.

Contact between the guide surfaces 15 and 33 serves to provide final accurate centering of the housing 3 in its rest position.

The invention is particularly advantageous in that it requires only a small number of parts in order to obtain the desired centering effect.

The connection assembly 1 is intended in particular to be integrated in equipment on board an aircraft, in particular equipment including a kitchen element. It should be understood that that constitutes merely one particular application, and the connection assembly of the invention can be used in installations that are stationary or mounted on board other types of vehicle for locomotion by land, by air, or by water.

Naturally, the invention is not restricted to the embodiment described above.

Figure 7:
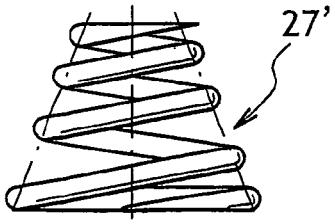
FIG. 7 is a diagrammatic and fragmentary view of a conical coil spring.

In particular, the spring 27 can be replaced by a conical coil spring 27', as shown in FIG. 7.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A connection assembly comprising:

a support including an opening, the opening extending substantially in a plane;

an electrical connector housing, and assembly means for assembling the connector housing to the support, the assembly means being configured firstly to enable the housing to be held relative to the support in a rest position in which the housing extends at least in part through the opening in the support, and secondly to enable the connector housing to move relative to its rest position, at least in a direction parallel to the plane of the opening, said assembly means including at least one resilient return member configured to be capable of deforming elastically to accompany movement of the connector housing in a direction parallel to the plane of the opening to return the connector housing to its rest position, wherein the assembly means comprises at least a first guide surface made on a retaining member for retaining the resilient return member and the connector housing includes at least a second guide surface, the first and second guide surfaces being configured to bear one against the other when the connector housing is in the rest position, wherein the resilient return member comprises a coil spring, and wherein the retaining member includes a shank engaged between turns of the spring, the shank being connected to a head secured to one end of the spring, and the retaining member including a base secured to the support, the first guide surface being formed on said base.

2. An assembly according to claim 1, wherein the resilient return member is configured to be capable of deforming elastically to accompany movement of the connector housing in a direction that is not parallel to the plane of the opening.

3. An assembly according to claim 1, the support including an edge that defines the opening, wherein, in the rest position, the connector housing does not contact the edge of the opening.

4. An assembly according to claim 1, wherein, in the rest position, the connector housing does not contact the support.

5. An assembly according to claim 1, wherein the resilient return member is configured to work in compression.

6. An assembly according to claim 1, wherein the resilient return member is secured over a fraction of a height thereof to the retaining member in such a manner that over said fraction of the height thereof there is substantially no radial clearance between the resilient return member and the retaining member.

7. An assembly according to claim 1, wherein the head and the shank are made as a single piece.

8. An assembly according to claim 1, wherein the connector housing includes a shoulder, against which the resilient return member comes to bear.

9. An assembly according to claim 1, wherein the connector housing includes a setback in which the resilient return member extends at least in part over a fraction of a height thereof.

10. An assembly according to claim 1, wherein the assembly means comprises at least two resilient return members and at least two retaining members, each associated with a respective resilient return member, the assembly means enabling the connector housing to be held in at least two locations of the support.

11. An assembly according to claim 1, wherein the connector housing includes at least one guide stud projecting from a face of the housing and being configured to cooperate with a complementary connector.

12. An assembly according to claim 1, wherein the connector housing includes at least one cavity configured to receive an insulating block for holding electrical contacts.

13. Equipment for mounting onboard an aircraft, the equipment including a connection assembly according to claim 1.

14. An assembly according to claim 1, wherein the connector housing includes an orifice through which said retaining member extends, at least in part.

15. An assembly according to claim 14, wherein said second guide surface in the connector housing is adjacent to said orifice.

16. An assembly according to claim 14, wherein the connector housing includes a shoulder against which the resilient return member comes to bear, and wherein the shoulder is adjacent to the orifice.

17. An assembly according to claim 14, wherein the connector housing includes at least one lateral slot opening into the orifice, the at least one lateral slot being configured to enable the retaining member to be inserted into the orifice.

18. A connection assembly comprising:

a support including an opening, the opening extending substantially in a plane;

an electrical connector housing; and assembly means for assembling the connector housing to the support, the assembly means being configured firstly to enable the housing to be held relative to the support in a rest position in which the housing extends at least in part through the opening in the support, and secondly to enable the connector housing to move relative to its rest position, at least in a direction parallel to the plane of the opening, said assembly means including at least one resilient return member configured to be capable of deforming elastically to accompany movement of the connector housing in a direction parallel to the plane of the opening to return the connector housing to the rest position, wherein the assembly means includes at least one retaining member for retaining the resilient return member, wherein the connector housing includes an orifice through which said retaining member extends, at least in part, and wherein the connector housing includes at least one lateral slot opening into the orifice, the at least one lateral slot being configured to enable the retaining member to be inserted into the orifice, wherein the resilient return member comprises a coil spring, and wherein the retaining member includes a shank engaged between turns of the spring, the shank being connected to a head secured to one end of the spring.

19. Equipment for mounting onboard an aircraft, the equipment including a connection assembly according to claim 18.

20. A connection assembly comprising:

a support including an opening, the opening extending substantially in a plane;

an electrical connector housing; and assembly means for assembling the connector housing to the support, the assembly means being configured firstly to enable the housing to be held relative to the support in a rest position in which the housing extends at least in part through the opening in the support, and secondly to enable the connector housing to move relative to its rest position, at least in a direction parallel to the plane of the opening, said assembly means including at least one resilient return member configured to be capable of deforming elastically to accompany movement of the connector housing in a direction parallel to the plane of the opening to return the connector housing to the rest position, wherein, in the rest position, the connector housing does not contact the support, wherein the assembly means comprises at least a first guide surface, wherein the connector housing includes at least a second guide surface, and wherein the first and second guide surfaces are configured to bear one against the other when the connector housing is in the rest position, wherein the first guide surface is made on a retaining member for retaining the resilient return member, and wherein the retaining member includes a base secured to the support, the first guide surface being formed on said base.

21. Equipment for mounting onboard an aircraft, the equipment including a connection assembly according to claim 20.

22. A connection assembly comprising:

a support including an opening, the opening extending substantially in a plane;

an electrical connector housing; and assembly means for assembling the connector housing to the support, the assembly means being configured firstly to enable the housing to be held relative to the support in a rest position in which the housing extends at least in part through the opening in the support, and secondly to enable the connector housing to move relative to its rest position, at least in a direction parallel to the plane of the opening, said assembly means including at least one resilient return member configured to be capable of deforming elastically to accompany movement of the connector housing in a direction parallel to the plane of the opening to return the connector housing to the rest position, wherein, in the rest position, the connector housing does not contact the support, wherein the assembly means includes at least one retaining member for retaining the resilient return member, wherein the connector housing includes an orifice trough which said retaining member extends, at least in part, and wherein the connector housing includes at least one lateral slot opening into the orifice, the at least one lateral slot being configured to enable the retaining member to be inserted into the orifice.

23. Equipment for mounting onboard an aircraft, the equipment including a connection assembly according to claim 22.

24. A connection assembly comprising:

a support including an opening, the opening extending substantially in a plane;

an electrical connector housing, the connector being of the rectangular type; and assembly means for assembling the connector housing to the support, the assembly means being configured firstly to enable the housing to be held relative to the support in a rest position in which the housing extends at least in part through the opening in the support, and secondly to enable the connector housing to move relative to its rest position, at least in a direction parallel to the plane of the opening, said assembly means including at least one resilient return member configured to be capable of deforming elastically to accompany movement of the connector housing in a direction parallel to the plane of the opening to return the connector housing to the rest position, wherein the assembly means comprises at least a first guide surface, wherein the connector housing includes at least a second guide surface, and wherein the first and second guide surfaces are configured to bear one against the other when the connector housing is in the rest position, wherein the first guide surface is made on a retaining member for retaining the resilient return member, and wherein the retaining member includes a base secured to the support, the first guide surface being formed on said base.

25. Equipment for mounting onboard an aircraft, the equipment including a connection assembly according to claim 24.

26. A connection assembly comprising:

a support including an opening, the opening extending substantially in a plane;

an electrical connector housing, the connector being of the rectangular type; and assembly means for assembling the connector housing to the support, the assembly means being configured firstly to enable the housing to be held relative to the support in a rest position in which the housing extends at least in part through the opening in the support, and secondly to enable the connector housing to move relative to its rest position, at least in a direction parallel to the plane of the opening, said assembly means including at least one resilient return member configured to be capable of deforming elastically to accompany movement of the connector housing in a direction parallel to the plane of the opening to return the connector housing to the rest position, wherein the assembly means includes at least one retaining member for retaining the resilient return member, wherein the connector housing includes an orifice through which said retaining member extends, at least in part, and wherein the connector housing includes at least one lateral slot opening into the orifice, the at least one lateral slot being configured to enable the retaining member to be inserted into the orifice.

27. Equipment for mounting onboard an aircraft, the equipment including a connection assembly according to claim 26.

* * * * *